US007898497B2

(12) United States Patent
Syed et al.

(10) Patent No.: US 7,898,497 B2
(45) Date of Patent: Mar. 1, 2011

(54) ENCLOSED REFLECTOR ANTENNA MOUNT

(75) Inventors: Junaid Syed, Crescent (GB); Chris Hills, Glenrothes (GB); Allan Tasker, Kirkcaldy (GB); Ian Renilson, Dalgety Bay (GB); Keith Tappin, Dunfermline (GB)

(73) Assignee: Andrew LLC, Hickory, NC (US)

( * ) Notice: Subject to any disclaimer, the term of this patent is extended or adjusted under 35 U.S.C. 154(b) by 349 days.

(21) Appl. No.: 12/243,033

(22) Filed: Oct. 1, 2008

(65) Prior Publication Data

US 2010/0079353 A1 Apr. 1, 2010

(51) Int. Cl.
*H01Q 3/02* (2006.01)

(52) U.S. Cl. ..... 343/882; 343/880

(58) Field of Classification Search ..... 343/878, 343/880, 882, 892, 757, 765, 766, 872
See application file for complete search history.

(56) References Cited

U.S. PATENT DOCUMENTS

| | | | | |
|---|---|---|---|---|
| 3,984,837 | A | 10/1976 | Tatnall | |
| 4,563,687 | A | 1/1986 | Berger | |
| 4,920,350 | A | 4/1990 | McGuire et al. | |
| 5,419,521 | A | 5/1995 | Matthews | |
| 6,198,452 | B1 * | 3/2001 | Beheler et al. | 343/757 |
| 7,042,407 | B2 | 5/2006 | Syed et al. | |
| 7,046,210 | B1 | 5/2006 | Brooker et al. | |
| 7,298,342 | B2 * | 11/2007 | Young et al. | 343/765 |
| 7,463,206 | B1 * | 12/2008 | Kyhle | 343/766 |
| 2004/0120418 | A1 | 6/2004 | Pasternak et al. | |
| 2005/0134512 | A1 | 6/2005 | Gottl et al. | |
| 2008/0150831 | A1 | 6/2008 | Tulloch | |
| 2009/0274130 | A1 | 11/2009 | Boch | |

FOREIGN PATENT DOCUMENTS

| | | |
|---|---|---|
| JP | 2006 211012 | 8/2006 |
| JP | 2008 227731 | 9/2008 |

OTHER PUBLICATIONS

Van Dooren, Gerry: International Search Report—related application serial No. PCT/IB2009/053718, issued Dec. 16, 2009 by European Patent Office.

* cited by examiner

*Primary Examiner*—Hoang V Nguyen
(74) *Attorney, Agent, or Firm*—Babcock IP, PLLC

(57) ABSTRACT

A reflector antenna mount for a reflector antenna with a primary mount coupled to a support arm. The primary mount rotatable in a first axis relative to the support arm. A secondary mount coupled to the primary mount; the secondary mount pivotable in a second axis relative to the primary mount. The reflector antenna coupled to a front side of the secondary mount; an electronics enclosure of the reflector antenna positioned on a back side of the secondary mount, the electronics enclosure coupled to the reflector antenna. A dielectric enclosure provided with a front face and a side surface coupled to the primary mount. The front face spaced away from the reflector antenna, outside of a range of motion of the directional antenna in the second axis.

19 Claims, 11 Drawing Sheets

ENCLOSED REFLECTOR ANTENNA MOUNT

BACKGROUND

1. Field of the Invention

This invention relates to reflector antenna mounts. More particularly, the invention relates to a cost efficient enclosed reflector antenna mount with improved visual aesthetics, electrical performance and alignment characteristics 2. Description of Related Art Terrestrial reflector antennas are used, for example, in communications systems to provide point to point communications links. Conventional reflector antennas apply a radome to provide environmental protection to the antenna feed and reflector dish surface, the radome extending across the reflector dish face. A conventional terrestrial reflector antenna is typically aligned with the signal source and/or desired receiver by orienting the entire reflector assembly at the antenna support connection(s) to the mounting point, for example a radio tower or mast.

A radome introduces an electrical discontinuity and thereby a signal reflection surface into the signal path. Radome configurations with surfaces that are angled with respect to the signal path direct reflected signal components away from the signal path to reduce return losses. U.S. Utility Pat. No. 7,042,407, issued May 9, 2006, titled "Dual Radius Twist Lock Radome and Reflector Antenna for Radome", by Syed et al, hereby incorporated by reference in the entirety, discloses a radome with a large radius of curvature within the antenna signal path and a smaller radius of curvature in the central area of the radome generally within the subreflector shadow.

Terrestrial reflector antenna radomes are typically limited to the reflector front face only, to avoid the greatly increased overall volume of a radome sized to enclose the full range of movement of the entire antenna assembly, such as a spherical or hemispherical enclosure. Further, full enclosure radomes also require substantially stronger mounting and support configurations because of the vastly increased wind loads a larger radome will encounter.

In some locations, such as residential and or nature preserve areas, installation of reflector antenna equipment may be subject to significant public opinion resistance, building codes and or neighborhood regulations due to a negative perception of the visual impact that antenna(s) and associated communications equipment may introduce to previously clear vistas.

Competition within the terrestrial reflector antenna industry has focused attention on RF signal pattern optimization, structural integrity, as well as materials and manufacturing operations costs. Also, increased manufacturing efficiencies, via standardized reflector antenna components usable in configurations adaptable for multiple frequency bands, are a growing consideration in the reflector antenna market.

Therefore, it is an object of the invention to provide an apparatus that overcomes deficiencies in the prior art.

BRIEF DESCRIPTION OF THE DRAWINGS

The accompanying drawings, which are incorporated in and constitute a part of this specification, illustrate embodiments of the invention and, together with a general description of the invention given above, and the detailed description of the embodiments given below, serve to explain the principles of the invention.

DETAILED DESCRIPTION

Figure 1:
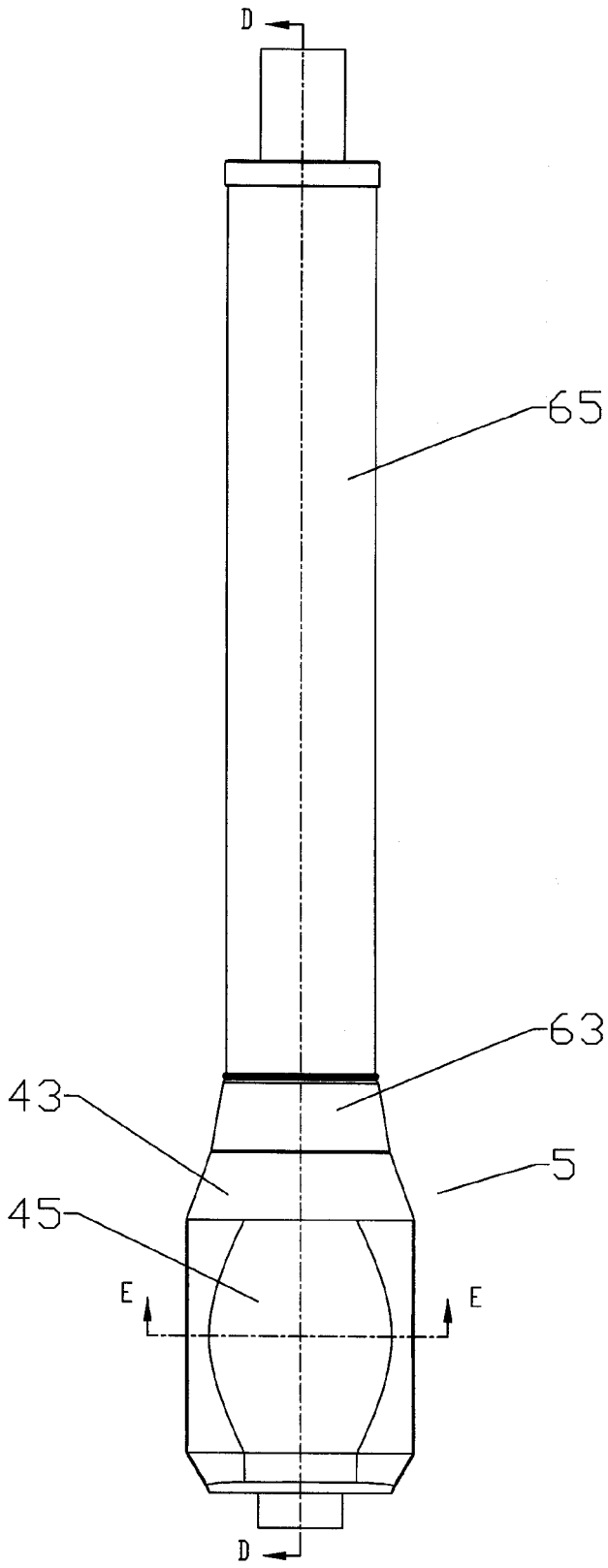
FIG. 1 is a schematic front view of an exemplary enclosed reflector antenna mount shown in combination with a second antenna enclosure, a cellular base station antenna.

The inventors have recognized that a key aspect of public visual aesthetics resistance to installation of terrestrial reflector antennas is the traditional open configuration of a conventional reflector, radome, transceiver and mounting structure. Further, the inventors have recognized that the size of an aesthetically improved reflector antenna enclosure can be significantly reduced when the enclosure rotates with the antenna and antenna mount on one of the two axis of travel.

As shown in FIGS. 1-7, an exemplary embodiment of an enclosed reflector antenna mount 5 has a primary mount 7 coupled to a support arm 9. The primary mount 7 is rotatable in a first axis with respect to the support arm 9. In the present configuration, the first axis is the horizontal or azimuth axis. The primary mount 7 supports a secondary mount 11 pivotable in a second axis. In the present configuration, the second axis is the vertical or elevation axis. The reflector antenna 13 is mounted upon the secondary mount 11, the reflector base 15 on a front side 17 and an electronics enclosure 19, for example a transceiver, receiver and or transmitter, extending from the back side 21. In alternative embodiments, the electronics enclosure 19 may be omitted and signals from the reflector antenna routed to a remote location for further processing, for example via a waveguide and or coaxial cable.

Figure 5:
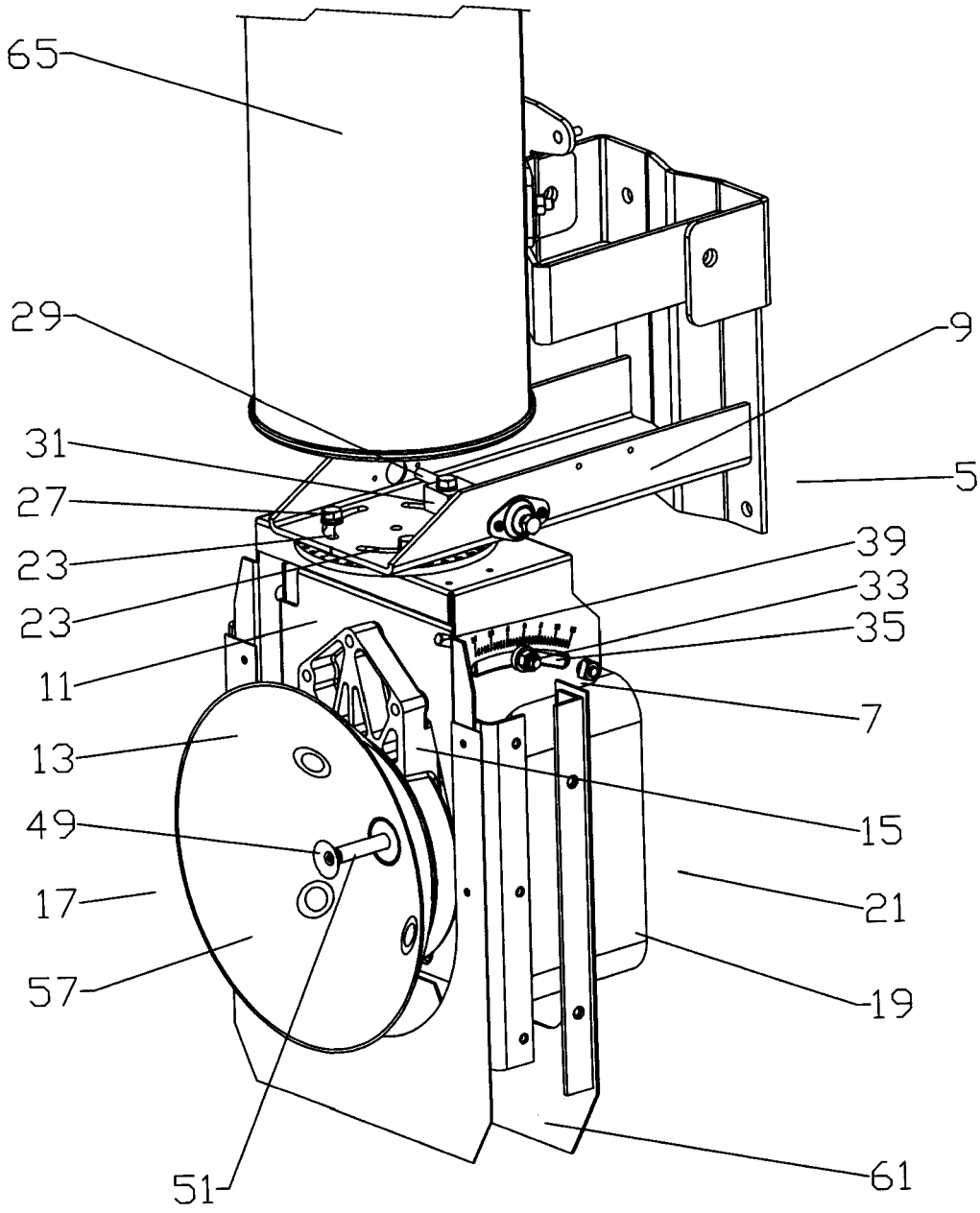
FIG. 5 is a schematic isometric view of a reflector antenna mount with the enclosure removed.
Figure 6:
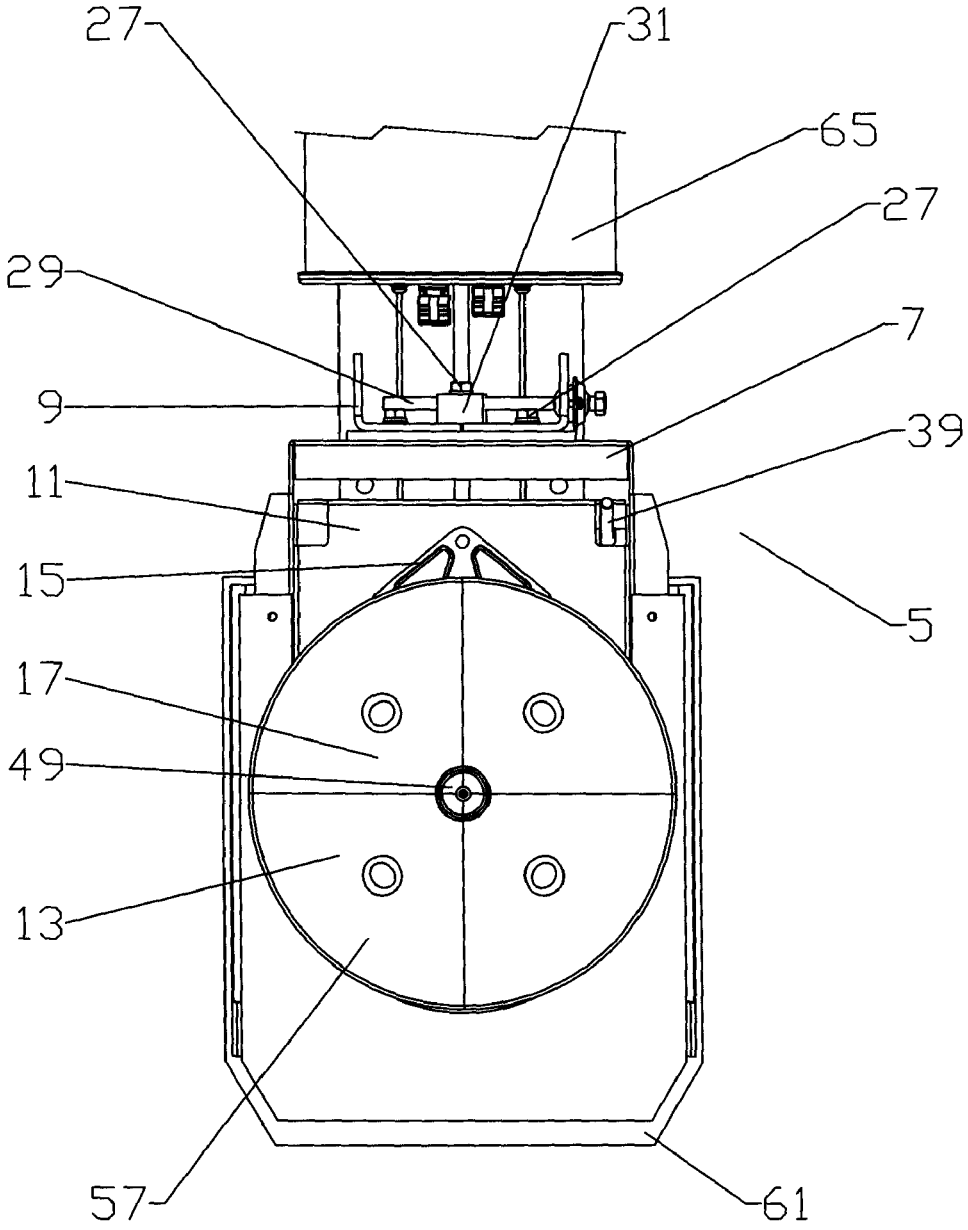
FIG. 6 is a schematic front of the FIG. 5 reflector antenna mount.
Figure 7:
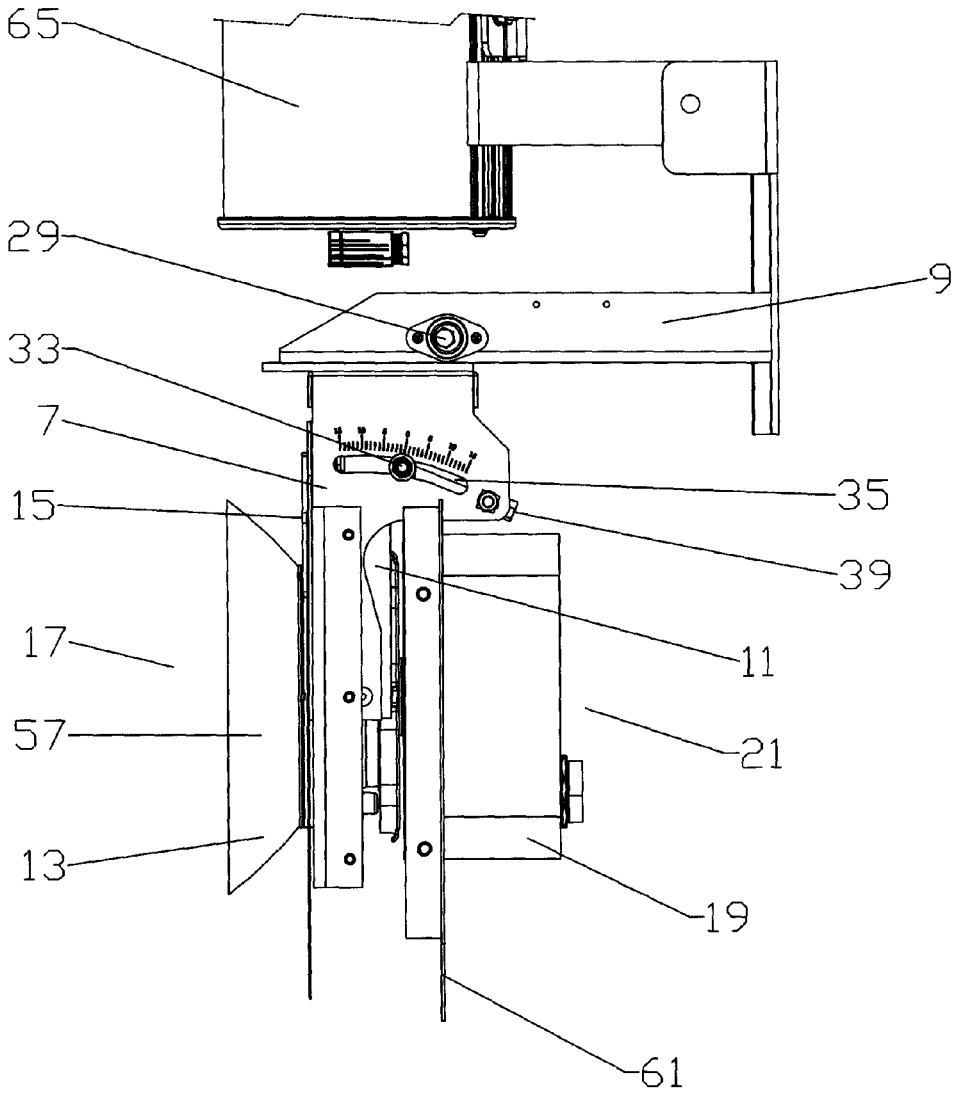
FIG. 7 is a schematic side view of the FIG. 5 reflector antenna mount.
Figure 8:
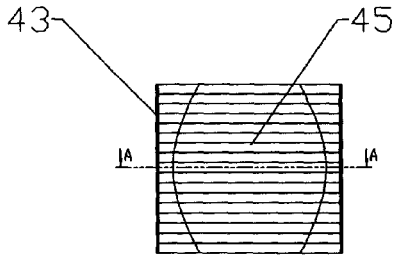
FIG. 8 is a front view of an antenna enclosure front face.
Figure 9:
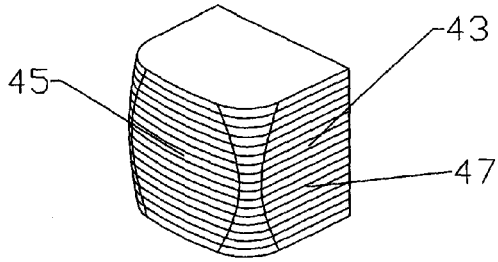
FIG. 9 is an isometric view of the front face and transitions to sidewalls of FIG. 8.
Figure 10:
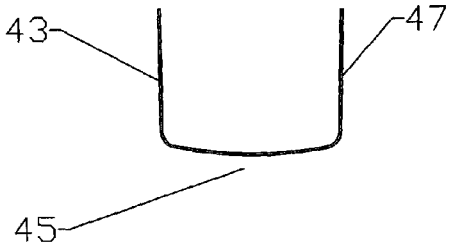
FIG. 10 is a top cross-section view taken along line A-A of FIG. 8.
Figure 11:
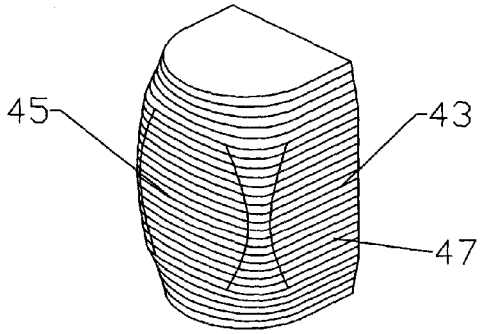
FIG. 11 is an isometric view of an enclosure with the front face of FIG. 8.
Figure 12:
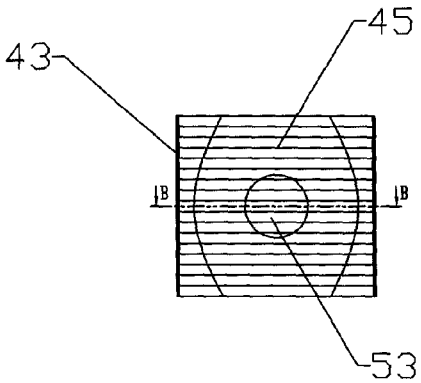
FIG. 12 is a front view of an antenna enclosure front face with a center portion.
Figure 13:
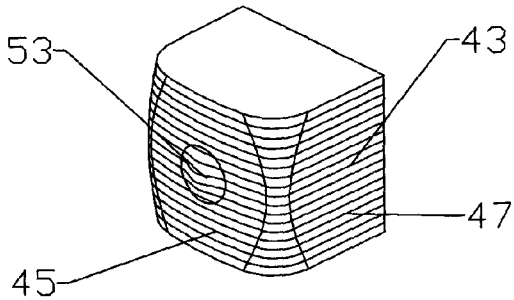
FIG. 13 is an isometric view of the front face and transitions to sidewalls of FIG. 12.
Figure 14:
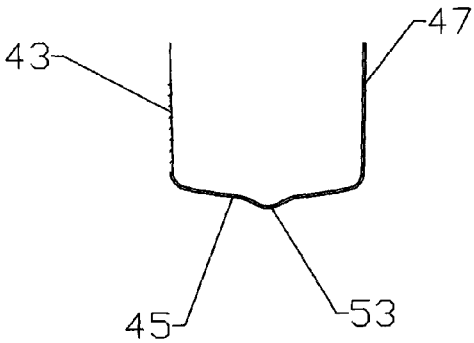
FIG. 14 is a top cross-section view taken along line B-B of FIG. 12.
Figure 15:
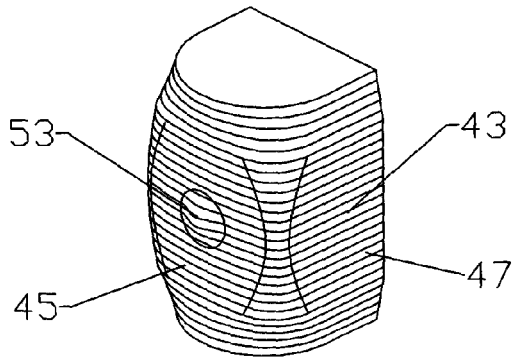
FIG. 15 is an isometric view of an enclosure with the front face of FIG. 12.
Figure 16:
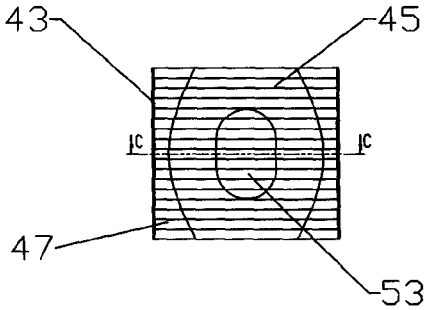
FIG. 16 is a front view of an antenna enclosure front face with an extended center portion.
Figure 17:
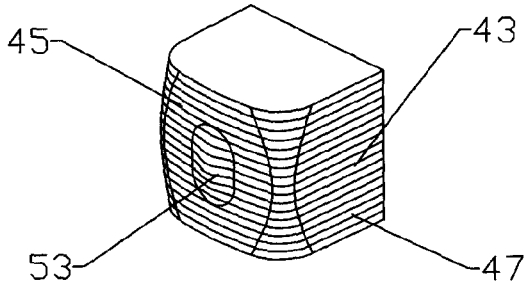
FIG. 17 is an isometric view of the front face and transitions to sidewalls of FIG. 16.
Figure 18:
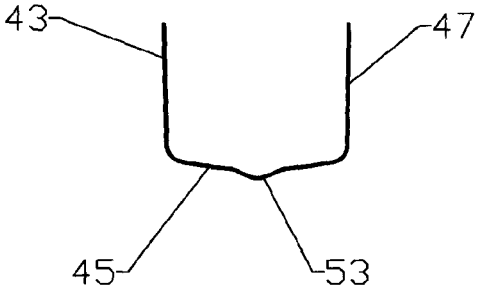
FIG. 18 is a top cross-section view taken along line C-C of FIG. 16.
Figure 19:
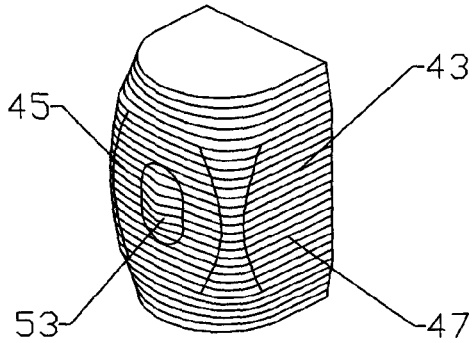
FIG. 19 is an isometric view of an enclosure with the front face of FIG. 16.

The rotatable connection between the support arm 9 and the primary mount 7, best shown in FIGS. 5-7, may be configured, for example, as a plurality of primary slot(s) 23 in the support arm 9 formed as arc segments having a common primary centerpoint 25. Primary fastener(s) 27 through the primary slot(s) 23, coupled to the primary mount 7, enable rotation of the primary mount 7 with respect to the support arm 9 through the extent of the primary slot(s) 23. A primary threaded rod 29 pivotably supported by the support arm 9 may be configured to thread in and out of a primary axis block 31 coupled to one of the primary fastener(s) 27, thus driving the rotation of the primary mount 7 through the range of motion with a high degree of precision via rotation adjustments to the primary threaded rod 29. Once the desired orientation in the primary axis is set, the primary mount 7 may be locked in place by tightening the primary fastener(s) 27.

The pivotable connection between the primary mount 7 and the secondary mount 11 may use a similar arrangement of secondary fastener(s) 33 in at least one secondary slot(s) 35 with an arc configuration arranged about a secondary centerpoint 37. A secondary threaded rod 39 pivotably supported by the primary mount 7 may be configured to thread in and out of a secondary axis block (not shown) coupled to one of the secondary fastener(s) 33, thus driving the rotation of the secondary mount 11 through the range of motion with a high degree of precision via rotation adjustments to the secondary threaded rod 39. Once the desired orientation in the second axis is set, the secondary mount 11 may be locked in place by tightening the secondary fastener(s) 33.

One skilled in the art will appreciate that the arrangement with respect to the location of the primary and secondary slot(s) 23, 35 may be reversed in an alternative equivalent structure. That is, the primary and secondary slot(s) 23, 35 may be located on the primary mount 7 and secondary mount 11, respectively, and the respective primary and secondary fastener(s) 27, 33 instead coupled to the support arm 9 and primary mount, respectively.

Figure 2:
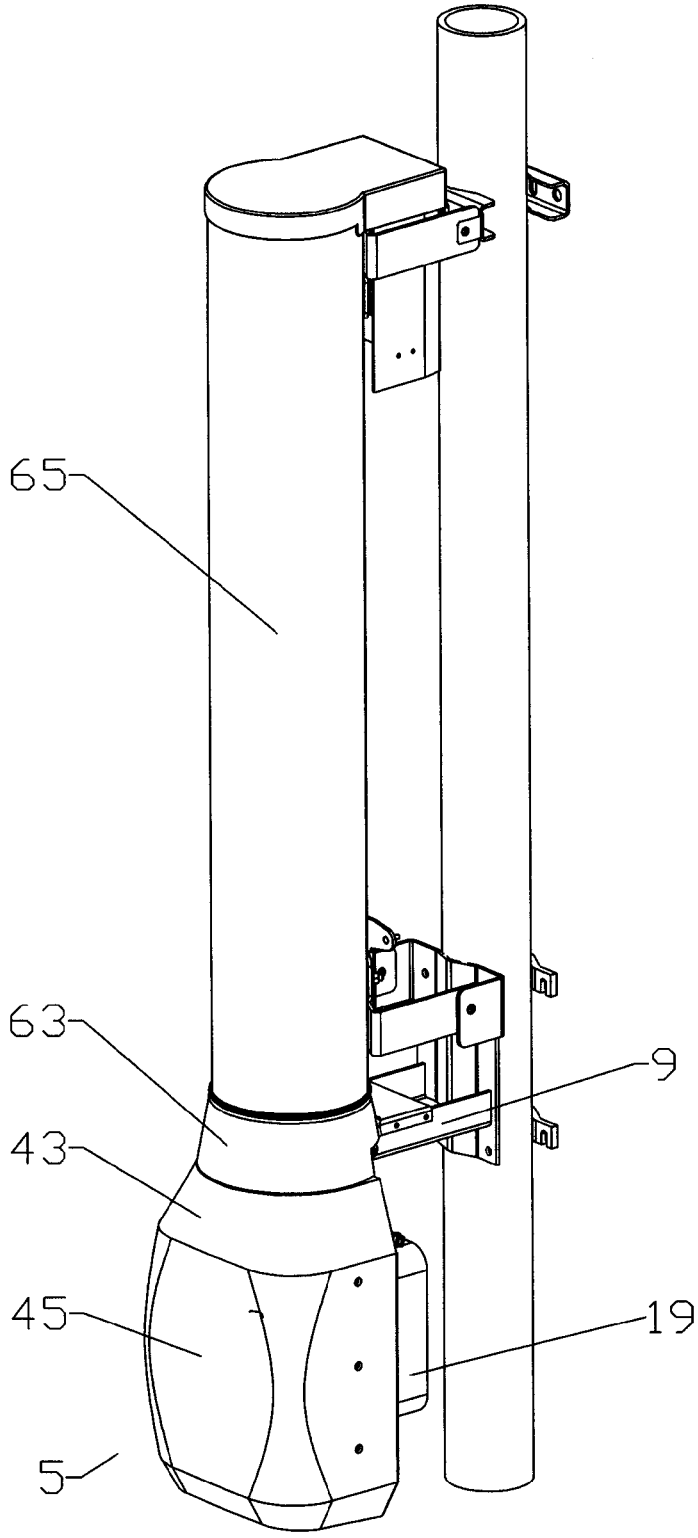
FIG. 2 is a schematic isometric view of the enclosed reflector antenna mount of FIG. 1.
Figure 3:
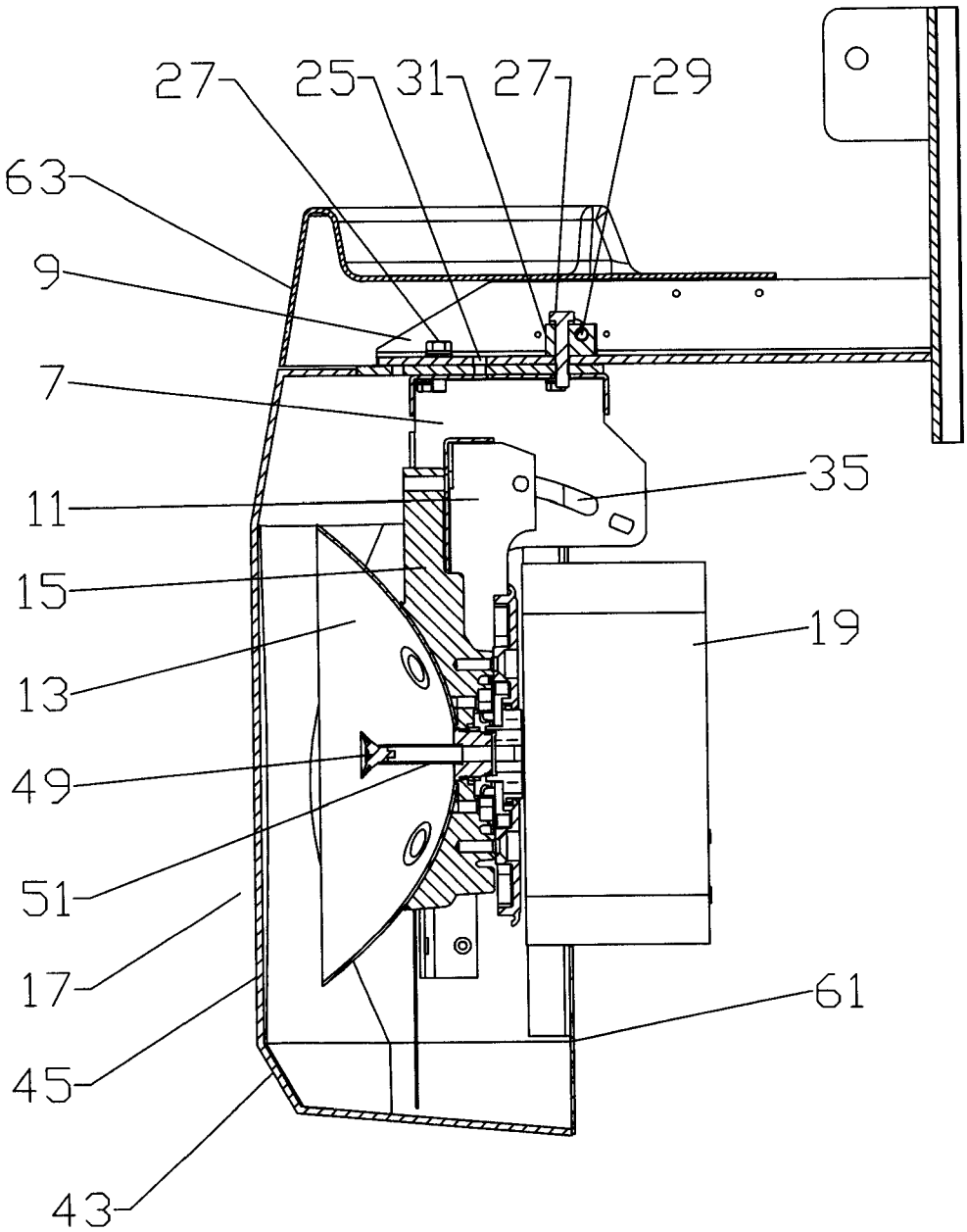
FIG. 3 is a schematic isometric cross section view of the reflector antenna mount along line D-D of FIG. 1.

An enclosure 43, best shown in FIGS. 1 and 2, coupled to the primary mount 7, rotates with the reflector antenna mount 5 about the first axis. The enclosure 43 has a front face 45, and a side surface 47 that wraps about the primary and secondary mount 7, 11 periphery. The front face 45 operates as the radome, spaced far enough forward to allow clearance for the reflector antenna 13 range of motion while pivoting through the second axis.

As shown in FIGS. 8-19, the front face 45 may be configured with a large radius of curvature, for example a radius of curvature at least three times a radius of the reflector antenna, to reduce reflection of signals from the front face 45 back to the subreflector 49 and feed 51. Further optimization of the contribution of the enclosure 43 to the electrical performance may be achieved by adding a center portion 53, generally in the shadow of the sub reflector 49, with a reduced radius of curvature to focus any signal reflections upon this area of the front face 45 upon subreflector RF absorbing material 55 placed on an outer surface of the sub reflector 49 and/or at the area proximate the intersection of the feed 51 with the reflector 57. To improve the return loss reduction contribution of the reduced radius of curvature center portion 53 throughout the range of motion along the secondary axis, the center portion 53 may be elongated so that when pointed at either extent along the secondary axis, one end or the other of the center portion 53 remains positioned generally in the shadow of the sub reflector 49.

Figure 4:
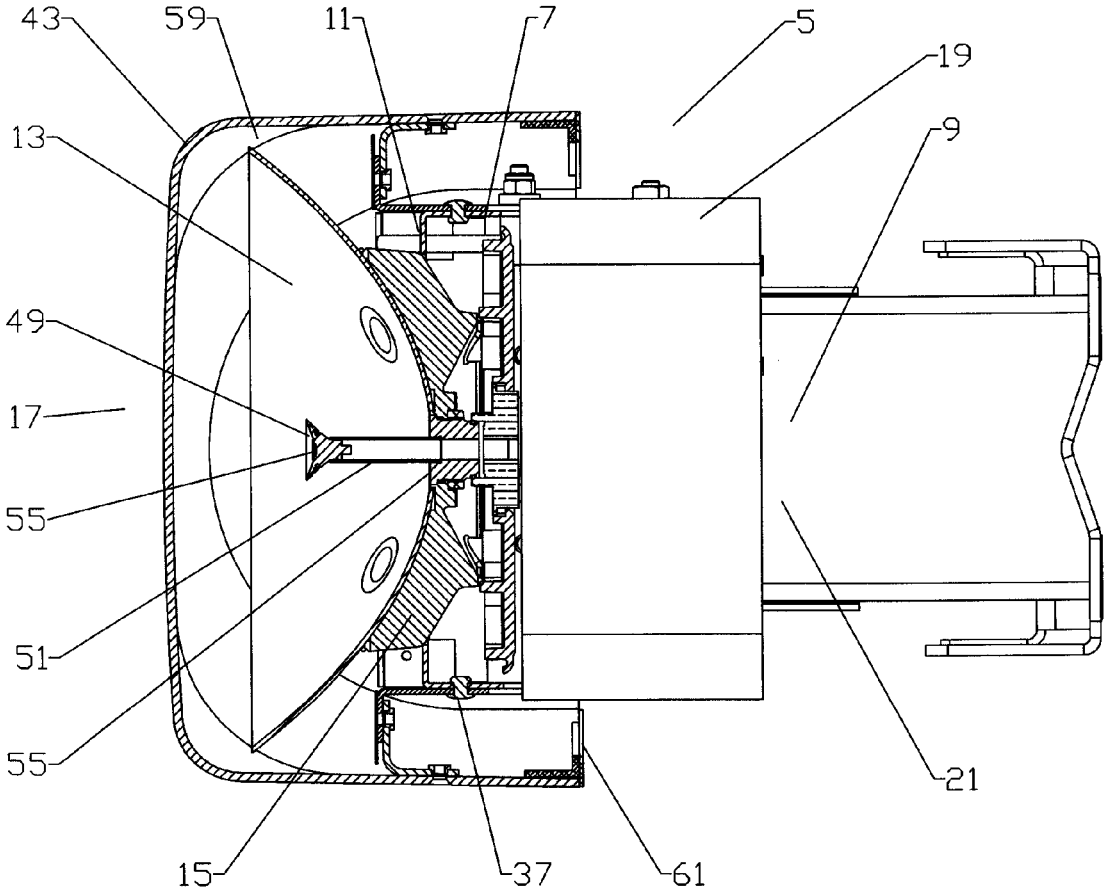
FIG. 4 is a schematic isometric cross section view of the reflector antenna mount along line E-E of FIG. 1.

The side surface 47 of the enclosure 43 may be configured with no overhanging edges, enabling cost effective high shape precision manufacturing via, for example, dielectric polymer injection molding or vacuum forming. To minimize introduction of phase errors or the like, the enclosure 43 front face 45 may be configured with a constant material thickness. To reduce the generation of back lobes, the inner side of the enclosure 43 side surface 47 may be configured with side surface RF absorbing material 59, for example as shown in FIG. 4.

A back plate 61 may be added to the enclosure 43 to suppress back lobes and or provide an environmental seal of the enclosure 43 around the primary and secondary mounts 7, 11. The back plate 61 may be configured to clear the primary and secondary mounts 7, 11 and the electronics enclosure 19 as they move through the extents of the second axis, while leaving space for tool access to the secondary fastener(s) 33.

To provide a streamlined external appearance with respect to a co-mounted antenna such as a cellular base station antenna, other form of panel antenna or additional reflector antenna(s), arranged with a shared mounting associated with the support arm 9, an adapter cowling 63 may be placed to cover an interconnection gap, if any, between the reflector antenna enclosure 5 and the second antenna enclosure 65 as shown in FIGS. 1 and 2.

Figure 20:
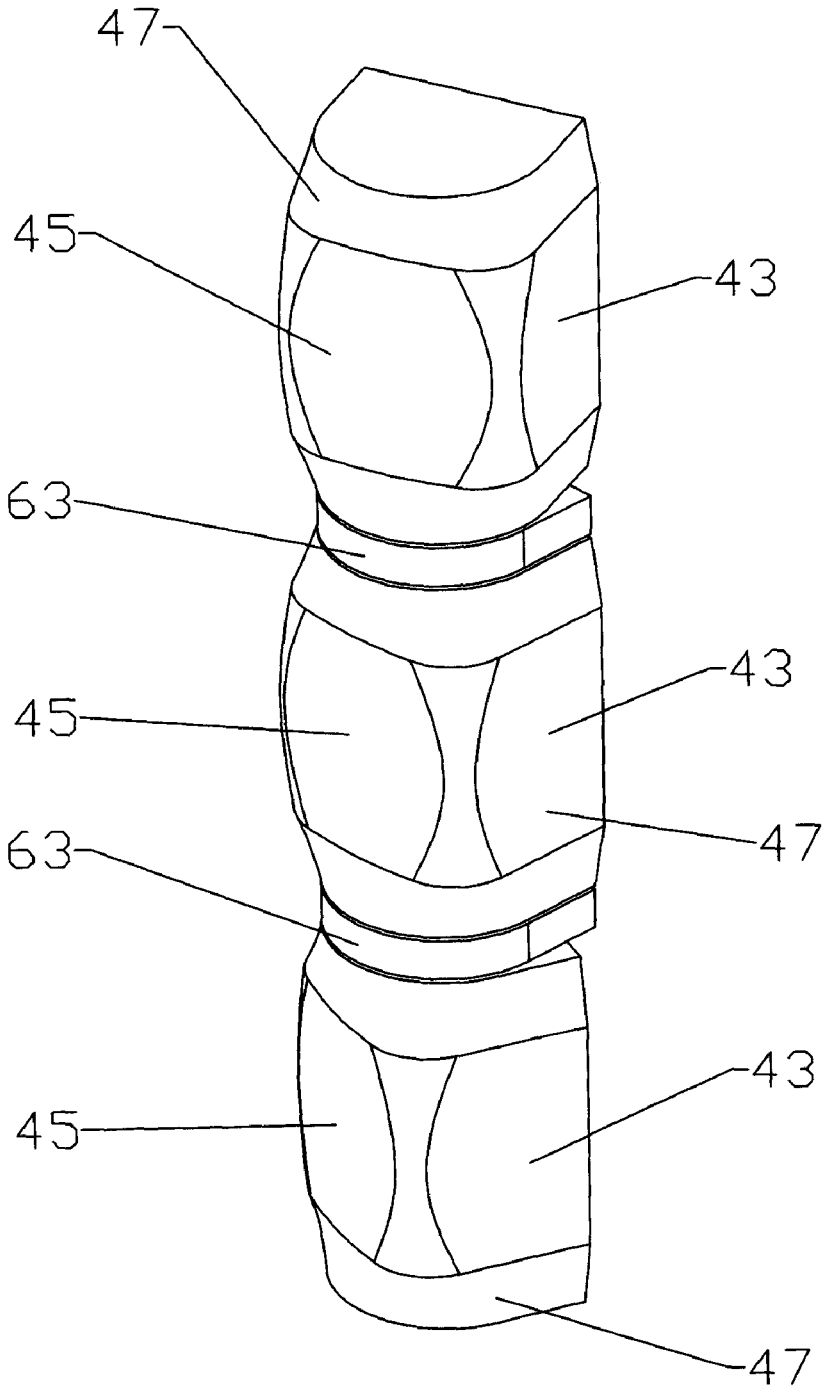
FIG. 20 is schematic front isometric view of a plurality of reflector antenna mounts coupled together.

Similarly, the reflector antenna enclosure 5 may be configured with a plurality of other reflector antenna enclosure(s), for example, as shown in FIG. 20. Further, although the stacking has been demonstrated as vertical, the multiple antenna enclosures may be aligned in a horizontal configuration, which exchanges the first and second axes.

One skilled in the art will recognize that an enclosed reflector antenna mount 5 according to the invention provides improved environmental protection and visual aesthetics without sacrificing electrical performance or unacceptably increasing manufacturing costs. Because the enclosure 43 is sized to accommodate only the internal movement of the reflector antenna 13 along a single arc path, the enclosure 43 may be made smaller and closer fitting than previous terrestrial reflector antenna enclosures. Further, installation is greatly simplified via the primary mounting via the support arm 9 attachment to the selected support structure and later fine tuning of the antenna pointing via easy adjustment of the primary and secondary mounts 7, 11.

Table of Parts

| | |
|---|---|
| 5 | reflector antenna mount |
| 7 | primary mount |
| 9 | support arm |
| 11 | secondary mount |
| 13 | reflector antenna |
| 15 | reflector base |
| 17 | front side |
| 19 | electronics enclosure |
| 21 | back side |
| 23 | primary slot |
| 25 | primary centerpoint |
| 27 | primary fastener |
| 29 | primary threaded rod |
| 31 | primary axis block |
| 33 | secondary fastener |
| 35 | secondary slot |
| 37 | secondary centerpoint |
| 39 | secondary threaded rod |
| 43 | enclosure |
| 45 | front face |
| 47 | side surface |
| 49 | subreflector |
| 51 | feed |
| 53 | center portion |
| 55 | subreflector RF absorbing material |
| 57 | reflector |
| 59 | side surface RF absorbing material |
| 61 | back plate |
| 63 | adapter cowling |
| 65 | second antenna enclosure |

Where in the foregoing description reference has been made to ratios, integers, components or modules having known equivalents then such equivalents are herein incorporated as if individually set forth.

While the present invention has been illustrated by the description of the embodiments thereof, and while the embodiments have been described in considerable detail, it is not the intention of the applicant to restrict or in any way limit the scope of the appended claims to such detail. Additional advantages and modifications will readily appear to those skilled in the art. Therefore, the invention in its broader aspects is not limited to the specific details, representative apparatus, methods, and illustrative examples shown and described. Accordingly, departures may be made from such details without departure from the spirit or scope of applicant's general inventive concept. Further, it is to be appreciated that improvements and/or modifications may be made thereto without departing from the scope or spirit of the present invention as defined by the following claims.

We claim:

1. A reflector antenna mount for a reflector antenna, comprising:

a primary mount coupled to a support arm; the primary mount rotatable in a first axis relative to the support arm;

a secondary mount coupled to the primary mount; the secondary mount pivotable in a second axis relative to the primary mount;

the reflector antenna coupled to a front side of the secondary mount;

a dielectric enclosure provided with a front face and a side surface coupled to the primary mount; the enclosure rotatable fixedly with the primary mount along the first axis; and the front face spaced away from the reflector antenna, outside of a range of motion of the directional antenna in the second axis.

2. The reflector antenna mount of claim 1, wherein the front face has a radius of curvature at least three times a radius of the reflector antenna.

3. The reflector antenna mount of claim 1, further including a center portion on the front face generally in a shadow of a subreflector of the reflector antenna.

4. The reflector antenna mount of claim 3, wherein the center portion is elongated in the second axis such that when the reflector antenna is pivoted through an extent of a range of motion in the second axis, a portion of the center portion remains generally in the shadow of the subreflector.

5. The reflector antenna mount of claim 3, further including subreflector RF absorbing material on a front side of the subreflector.

6. The reflector antenna mount of claim 1, further including a back plate coupled to the dielectric enclosure; the back plate partially closing the dielectric enclosure towards an electronics enclosure coupled to a back side of the secondary mount.

7. The reflector antenna mount of claim 1, wherein the rotation of the primary mount is along a plurality of arc shaped primary slot(s) formed in the support arm, each having a radius of curvature around a primary centerpoint; a primary fastener coupled to the primary mount extending through each slot.

8. The reflector antenna mount of claim 7, wherein a primary threaded rod pivotably supported by the support arm is threaded through a primary axis block coupled to one of the primary fasteners; the primary threaded rod driving the primary axis block to move the primary mount through the first axis.

9. The reflector antenna mount of claim 1, wherein the pivoting of the secondary mount is along a plurality of arc shaped secondary slot(s) formed in the primary mount, each having a radius of curvature around a secondary centerpoint; a secondary fastener coupled to the secondary mount extending through each secondary slot.

10. The reflector antenna mount of claim 9, wherein a secondary threaded rod pivotably supported by the primary mount is threaded through a secondary axis block coupled to one of the secondary fasteners; rotation of the secondary threaded rod driving the secondary axis block to move the secondary mount through the second axis.

11. The reflector antenna mount of claim 1, wherein the enclosure has a constant thickness across the front face.

12. The reflector antenna mount of claim 1, further including side surface RF absorbing material on the side surface.

13. The reflector antenna mount of claim 1, wherein the dielectric enclosure front face extends longer in the second axis than in the first axis.

14. The reflector antenna mount of claim 1, wherein the support arm is coupled to a second antenna enclosure.

15. The reflector antenna mount of claim 14, further including an adapter cowling covering a space between the reflector antenna mount and the second antenna enclosure.

16. The reflector antenna mount of claim 14, wherein the second antenna enclosure is aligned vertically with the reflector antenna.

17. The reflector antenna mount of claim 14, wherein the second antenna enclosure is aligned horizontally with the reflector antenna.

18. The reflector antenna mount of claim 14, wherein the second antenna enclosure is a second reflector antenna in a second reflector antenna mount.

19. A reflector antenna mount for a reflector antenna, comprising:

a primary mount coupled to a support arm; the primary mount rotatable in a first axis relative to the support arm;

a secondary mount coupled to the primary mount; the secondary mount pivotable in a second axis relative to the primary mount;

the reflector antenna coupled to a front side of the secondary mount;

an electronics enclosure of the reflector antenna positioned on a back side of the secondary mount, the electronics enclosure coupled to the reflector antenna;

a dielectric enclosure provided with a front face and a side surface coupled to the primary mount;

the front face spaced away from the reflector antenna, outside of a range of motion of the directional antenna in the second axis;

the front face having a radius of curvature at least three times a radius of the reflector antenna;

a center portion on the front face generally in a shadow of a subreflector of the reflector antenna; the center portion having a radius of curvature less than a radius of the reflector antenna;

the center portion is elongated in the second axis such that when the reflector antenna is pivoted through an extent of a range of motion in the second axis, a portion of the center portion remains generally in the shadow of the subreflector; and a back plate coupled to the enclosure; the back plate partially closing the dielectric enclosure towards the electronics enclosure.

* * * * *